United States Patent [19]

Katsura et al.

[11] Patent Number: 4,775,560

[45] Date of Patent: Oct. 4, 1988

[54] HEAT-RESISTANT PAPER CONTAINER AND PROCESS FOR PREPARATION THEREOF

[75] Inventors: Tadahiko Katsura; Takaaki Mochida, both of Yokohama; Toshiaki Iioka, Chigasaki; Toshifumi Tanabashi; Seishichi Kobayashi, both of Yokohama, all of Japan

[73] Assignee: Toyo Seikan Kaisha, Ltd., Tokyo, Japan

[21] Appl. No.: 43,655

[22] Filed: Apr. 28, 1987

[30] Foreign Application Priority Data

Apr. 28, 1986 [JP] Japan ..... 61-96636
Aug. 29, 1986 [JP] Japan ..... 61-201829
Sep. 24, 1986 [JP] Japan ..... 61-223868

[51] Int. Cl.[4] ..... B65D 1/22; B32B 29/06

[52] U.S. Cl. ..... 428/35; 426/113; 426/523; 428/413; 428/537.5; 493/148; 229/3.5 R

[58] Field of Search ..... 426/113, 523; 493/148; 428/35, 413, 537.5; 229/3.5 R

[56] References Cited

U.S. PATENT DOCUMENTS 3,663,239 5/1972 Rowe et al. ..... 426/113
3,924,013 12/1975 Kane ..... 426/113
4,249,978 2/1981 Baker ..... 426/113
4,391,833 6/1983 Self et al. ..... 426/113
4,469,258 9/1984 Wright et al. ..... 426/113

*Primary Examiner*—John E. Kittle
*Assistant Examiner*—James J. Seidleck
*Attorney, Agent, or Firm*—Sughrue, Mion, Zinn, Macpeak, and Seas

[57] ABSTRACT

Disclosed is a heat-resistant paper container which comprises a bottomed seamless press-molded body comprising a laminate of a paper substrate having an elongation of at least 1.5% in the longitudinal direction and an elongation of at least 4.5% in the lateral direction and a coating layer of a hiding pigment formed on both the surfaces of the paper substrate, wherein the amount coated of the hiding pigment is 1 to 50 g/m$^2$, the binder in the coating layer is a thermosetting resin binder and the binder is present in the coating layer at a weight ratio $R_P$ satisfying the following conditions:

$$R_P = k \cdot O_A \cdot d_R \quad (1)$$

wherein $O_A$ stands for the oil absorption (ml/100 g) of the hiding pigment, $d_A$ stands for the density (g/ml) of the binder, and k is a number of from 0.005 to 0.2.

11 Claims, 3 Drawing Sheets

HEAT-RESISTANT PAPER CONTAINER AND PROCESS FOR PREPARATION THEREOF

BACKGROUND OF THE INVENTION (1) Field of the Invention

The present invention relates to a heat-resistant paper container and a process for the preparation thereof. More particularly, the present invention relates to a heat-resistant paper container, the content of which can be heated and cooked by a microwave oven, an electric oven or an oven toaster, and a process for the preparation thereof.

(2) Description of the Prior Art

A tray-shaped paper container is widely used as a container in which a content such as a food is simply and easily packaged. With the recent spread of an oven, a microwave oven, an oven toaster and the like, development of a tray-shaped container which is sold in the state filled with a precooked or uncooked food and which is placed in a heating device as mentioned above to heat or cook the food for eating is desired.

As means meeting this desire, Japanese Patent Publication No. 41890/82 discloses a process for preparing a paper for a food container, which comprises forming a paper stock which is substantially neutral, impregnating the paper stock with an aqueous dispersion containing an inorganic filler, forming a starting paper from the stock, applying a heat-resistant coating on both the surfaces by bonding or pasting and coating a heat-resistant resin on the surface to be formed into an inner surface of the container. As the heat-resistant coating, there can be used not only an aluminum foil but also a nitro cellulose type lacquer and a resin coating of the epoxy, urethane or fluorine type. It is taught that on the inner surface side of the container, a heat-resistent resin of the silicone type or the like is applied as a releasing agent on the heat-resistant coating.

This container can be applied to the use where a starting material such as a sweet rice jelly or sponge cake is packaged and heat-treated at a temperature of about 200° to about 250° C. However, in the case where heating or cooking is carried out by an oven toaster or the like, the temperature of the container is elevated to a level exceeding 300° C., and the heat resistance of the above-mentioned paper container is still insufficient and the container cannot be applied to this high-temperature use.

In cellulose fibers of paper, carbonization and discoloration start at about 260° C., and the fibers are completely carbonized at about 300° C. Accordingly, when a paper container is applied to the use where the container is heated above 300° C., the appearance of the container is blackened so that the container cannot be put into practical use, and the strength of the container per se is drastically reduced.

As means for hiding discoloration of a paper container, there should naturally be considered a method in which a coating layer comprising a hiding pigment and a resin binder is formed on the surface of a paper substrate. However, this coated paper is generally poor in the elongation necessary for molding and the press moldability to a tray is insufficient. If a pressing mold is heated to improve the moldability, the coating layer adheres to the mold and molding often becomes impossible. Even if the coating layer does not adhere to the pressing mold, the viscous resin component is gradually accumulated on the surface of the mold, resulting in reduction of the adaptability to the molding operation and occurrence of appearance defects of the formed container. This tendency may be moderated by applying a releasing agent to the mold surface but a drastic solution of the problem is not attained.

In addition to the above-mentioned problem concerning the molding, the conventional tray container composed of a coated paper involves a problem of generation of an unpleasant smell on heating in an oven, and the flavor of a packaged food or the like is degraded.

SUMMARY OF THE INVENTION

It is therefore a primary object of the present invention to provide a heat-resistant paper container composed of a paper laminate excellent in the moldability, which exerts good appearance characteristics, a high container strength and an excellent flavor-retaining property even when the container wall is heated at a temperature higher than 300° C.

Another object of the present invention is to provide a process in which a heat-resistant container having the above-mentioned excellent characteristics is prepared with a good adaptability to the molding operation without occurrence of the above-mentioned adhesion of the resin component to the mold.

In accordance with the present invention, there is provided a heat-resistant paper container which comprises a bottomed seamless press-molding body comprising a laminate of a paper substrate having an elongation of at least 1.5% in the longitudinal direction and an elongation of at least 4.5% in the lateral direction and a coating layer of a hiding pigment formed on both the surfaces of the paper substrate, wherein the amount coated of the hiding pigment is 1 to 50 g/m$^2$, the binder in the coating layer is a thermosetting resin binder and the binder is present in the coating layer at a weight ratio $R_P$ satisfying the following condition:

$$R_P = k \cdot O_A \cdot d_R \quad (1)$$

wherein $O_A$ stands for the oil absorption (ml/100 g) of the hiding pigment $d_R$ stands for the density (g/ml) of the binder, and k is a number of from 0.005 to 0.2.

Furthermore, in accordance with the present invention, there is provided a process for the preparation of heat-resistant paper containers, which comprises press-molding a laminate material into a bottomed seamless container in a heated mold, said laminate material comprising a paper substrate and a coating layer of a hiding pigment-containing thermosetting paint applied to both the surfaces of the paper substrate, wherein the thermosetting paint has a glass transition point of 90° to 130° C. as measured by a scanning calorimeter and the laminate has an elongation of at least 1.5% in the longitudinal direction and an elongation of at least 4.5% in the lateral direction, as measured at a temperature of 20° C. and a relative humidity of 65%.

Moreover, in accordance with the present invention, there is provided a bottomed seamless molded container, which comprises a paper substrate and a resin coating layer formed on at least one surface of the paper substrate, wherein the resin coating layer is formed so that the condition of $l/L < 0.1$ is satisfied, in which L stands for the thickness of the laminate and l stands for the permeation depth into the paper substrate from the surface of the coating layer.

Still further, in accordance with the present invention, there is provided a process for the preparation of a bottomed seamless molded container of paper, which comprises coating an aqueous dispersion comprising a hiding pigment and a thermosetting resin having an average particle size of 0.05 to 1.0 μm as dispersed substances on at least one surface of a paper substrate, drying the coating layer to cure the thermosetting resin, and molding the obtained laminate into a bottomed seamless container.

Still in addition, in accordance with the present invention, there is provided a process for the preparation of a bottomed seamless molded container of paper, which comprises coating an aqueous paint comprising a hiding pigment as the dispersed substance and a water-soluble thermosetting epoxy-acrylic resin as the resin component on at least one surface of a paper substrate, drying the coating layer to cure the thermosetting resin, and press-molding the obtained laminate in a bottomed seamless container.

Figure 1:
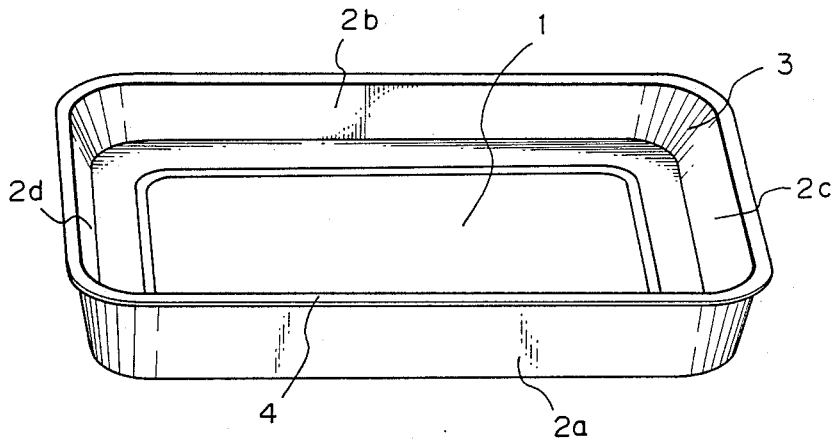
FIG. 1 is a perspective view illustrating a heat-resistant paper container according to the present invention.

In the drawings, reference numeral 1 represents a bottom, each of reference numerals 2*a*, 2*b*, 2*c* and 2*d* represents a side wall, reference numeral 3 represents a fold, reference numeral 4 represents a flange or curl portion, reference numeral 10 represents a wall, reference numeral 11 represents a substrate, and each of reference numerals 12*a* and 12*b* represents a heat-resistant coating layer.

DETAILED DESCRIPTION OF THE PREFERRED EMBODIMENTS

Referring to the perspective view of FIG. 1 illustrating a heat-resistant container according to the present invention, this tray-shaped paper container comprises a rectangular and plane bottom wall 1 and side walls 2*a*, 2*b*, 2*c* and 2*d* connected to the bottom wall 1, and folds 3 are present between every two contiguous side walls. A flange or curl portion 4 is formed on the top edges of the sidewalls.

Figure 2:
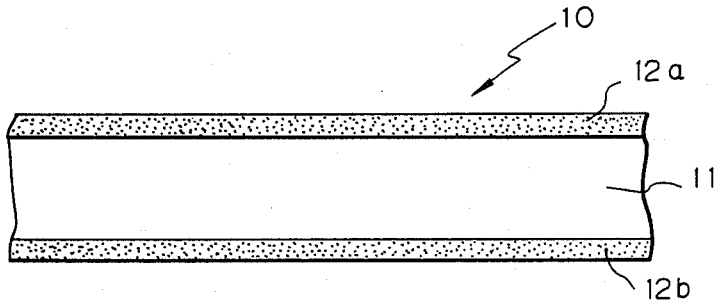
FIG. 2 is a view illustrating the sectional structure of the wall portion of the paper container according to the present invention.

Referring to FIG. 2 illustrating the sectional structure of the wall of this paper container in an enlarged state, the wall 10 comprises a paper substrate 11 and heat-resistant coating layers 12*a* and 12*b* applied to both the surfaces of the paper substrate.

From the viewpoint of the moldability, it is important that the paper substrate used in the present invention should have an elongation of at least 1.5% in the longitudinal direction and an elongation of at least 4.5% in the lateral direction. A coating layer of a hiding pigment is formed on the surface of the paper substrate 11, so that the paper substrate is prevented from being directly exposed to a high-temperature atmosphere and even if the paper substrate is carbonized, this carbonization is hidden. Even if this coating layer is formed, the elongation of the laminate is maintained at a level of at least 1.5% in the longitudinal direction and a level of at least 4.5% in the lateral direction and an excellent moldability is ensured.

The present invention is characterized in that a hiding pigment-containing thermosetting paint is used for the heat-resistant coating layers 12*a* and 12*b*. When a thermoplastic resin is used for the coating layers 12*a* and 12*b*, on press-molding the laminate into a container, such troubles as adhesion of the coating to the mold are readily caused, and on heating in an oven or the like, an unpleasant smell or taste is generated to degrade the flavor of a food or the like, and reduction of the strength of the container is extreme. However, if a thermosetting resin is used as the paint component, these disadvantages can be eliminated or moderated. The hiding pigment contained in the paint thermally insulates the paper substrate from a heated high-temperature atmosphere to control reduction of the strength of the paper substrate under heating to a very low level and imparts a heat resistance to the coating per se, and moreover, the hiding pigment exerts a function of hiding carbonized fibers formed in the paper substrate and maintaining a good appearance. Furthermore, the hiding pigment contained in the paint exerts an auxiliary function of somewhat reducing formation and accumulation of a viscous resinous product on the surface of the mold.

According to the present invention, by adjusting the amount coated of the hiding pigment to 1 to 50 g/m$^2$, especially 3 to 40 g/m$^2$, using a thermosetting resin such as an epoxy-acrylic resin as the binder in the coating layer and applying the binder of the coating layer at a weight ratio ($R_P$) satisfying the condition of the formula (1), the appearance characteristics, container characteristics and flavor-retaining property on heating in an oven or the like can be prominently improved while retaining a good moldability inherently possessed by the paper substrate.

If the amount coated of the hiding pigment is too small and below the above-mentioned range, the effect of insulating the paper substrate from a high-temperature atmosphere becomes insufficient and reduction of the paper substrate under heating is increased, and moreover, the effect of hiding carbonized fibers becomes insufficient. If the amount coated of the hiding pigment is too large and exceeds the above-mentioned range, the moldability is degraded and cracking, peeling and falling of the coating layer are readily caused.

The hiding pigment is anchored on the surface of the paper substrate through the binder. If a thermosetting binder such as an epoxy-acrylic resin is used as the binder, the moldability of the laminate is improved and also the flavor-retaining property under heating is improved. If binders customarily used, such as a styrene/-butadiene copolymer latex, an acrylic acid ester copolymer and casein are used, adhesion of the coating layer to the pressing mold is caused at the molding step and an unpleasant smell or taste is generated. However, these problems are effectively eliminated according to the present invention.

In the instant specification, the formula (1) has the following meaning. In the formula (1), $O_A$ on the right side represents the oil absorption (ml/100 g) of the hiding pigment and the product of this oil absorption and the density $d_R$ of the binder indicates the amount (grams) of the binder per 100 g of the pigment within the range where there can be formed a homogeneous composition in which the binder forms a continuous phase and the pigment forms a dispersed phase. Accordingly, if this composition is coated on the surface of a smooth and impermeable substrate such as a glass sheet, when the value of k on the right side of the formula (1) is 0.01 or larger, pigment particles are not exposed to the outer surface and a coating layer having no voids in the interior or no undulations in the vicinity of the surface is formed. If the value of k is smaller than 0.01, pigment particles are exposed to the outer surface or a coating layer having voids in the interior or undulations in the vicinity of the surface.

In the substrate used in the present invention, some permeation of the binder into the interior from the surface cannot be avoided. However, if the weight ratio ($R_P$) of the binder to the pigment provides a value k of 0.2 or smaller, pigment particles are exposed to the outer surface and a coating layer having voids in the interior or undulations in the vicinity of the surface is formed, and a laminate having such a coating layer has an elongation comparable to that of the paper substrate and the laminate can be easily molded into the form of a tray. The value k has a certain lower limit for maintaining a necessary adhesion force of the hiding pigment to the paper substrate, and if the value k is smaller than 0.005, falling or isolation of the hiding pigment is caused at the molding step and the heat-resistant strength of the wall of the container is reduced.

In accordance with one preferred embodiment of the present invention, by using a thermosetting paint coating having a glass transition point (Tg) of 90° to 130° C. as measured by a scanning calorimeter (DSC), the moldability is improved while preventing formation or accumulation of a substance adhering to the surface of the mold. As is well-known, the glass transition is a phenomenon in which a polymeric substance is changed from a glassy hard state to a rubbery state, and the temperature at which this phenomenon takes place is the glass transition point (Tg). At the measurement by the scanning calorimeter, Tg appears as the shoulder of endotherm as the point where the movement of the molecular chain begins. In case of a thermosetting resin, in general, the higher is the crosslinking degree, the higher is Tg.

The thermosetting resin having Tg of 90° to 130° C., that is used in the present invention, is regarded as having a substantially medium degree of crosslinking. If Tg is lower than 90° C., even though the coating layer comprises a thermosetting resin, it is difficult to prevent formation of accumulation of a viscous substance on the surface of the heated mold. On the other hand, if Tg is higher than 130° C., the processability of the coating is degraded and the moldability of the laminate is therefore degraded.

In the present invention, by using a thermosetting resin having Tg of 90° C. or higher, adhesion of a viscous substance to the surface of the mold is controlled. It is presumed that the reason may be as follows. It is considered that a thermosetting resin contains components having a relatively low molecular weight or uncondensed components. If Tg is elevated to 90° C. or higher, the movement of the molecular chain is controlled even to a relatively high temperature and the movement of the above-mentioned components is controlled by crosslinking in the molecular chain, with the result that migration of these components to the surface of the mold is inhibited.

In accordance with another preferred embodiment of the present invention, for formation of the coating layers **12*a* and 12*b***, an aqueous dispersion comprising a hiding pigment and a thermosetting resin having an average particle size of 0.05 to 1.0 μm as dispersed substances or an aqueous paint comprising a hiding pigment as the dispersed substance and a water-soluble thermosetting epoxy-acrylic resin as the resin component is used. Most of conventional paints comprising a pigment and a thermosetting resin are in the form of an organic solvent solution. However, if a paint of the organic solvent solution type is coated on a paper substrate, deep permeation of the thermosetting resin in the interior of the paper substrate cannot be avoided. In contrast, according to this preferred embodiment of the present invention, by applying the hiding pigment and thermosetting resin in the form of an aqueous dispersion or applying the thermosetting resin in the water-soluble form, permeation of the thermosetting resin into the paper substrate can be controlled to a very low level.

More specifically, supposing that the thickness of the container wall (laminate) 10 is L and the permeation depth of the resin coating layer **12*a* (12*b***) from the surface is l, according to the present invention, the value of l/L can be controlled to less than 0.1, preferably 0.015 to 0.08.

According to a certain paper quality, there may be brought about some difference between the maximum permeation depth and the minimum permeation depth. In this case, the average permeation depth should be regarded as l.

It is presumed that the reason why the permeation depth of the resin coating layers **12*a* and 12*b*** can be controlled to a low level by using a-water-dispersible or water-soluble resin may be as follows. In the present invention, a paper substrate comprising a neutral sizing agent such as an alkyl ketene dimer or alkenyl succinic anhydride or a rosin type sizing agent having a weakly acidic recipe in which the amount used of aluminum sulfate is reduced is used. The sizing treatment is carried out for imparting a water resistance to paper, that is, for preventing permeation of water in the interior of paper even if the paper surface is wetted with water. Accordingly, if an aqueous paint comprising water as the medium is coated on a paper substrate as in the present invention, permeation of the resin into the paper substrate is controlled to a very low level by the effect of the sizing agent. Generally, paper absorbs water or an organic solvent through clearances among fibers by the capillary action. In case of an aqueous dispersion comprising a resin having a size larger than the clearances among the fibers, permeation of the resin into the paper substrate is further controlled.

In this embodiment of the present invention, by controlling the permeation depth of the resin coating layers **12*a* and 12*b*** to a low level, the moldability and heat resistance of the laminate are improved. It is presumed that the reason may be as follows. It is deemed that the press-moldability of a paper substrate depends on the fact that paper fibers are appropriately entangled and interlaced with one another in the paper substrate to retain an appropriate elongation. However, if a thermosetting resin permeates deeply in the interior of the paper substrate, entangling and interlacing points are fixed and the elongation of the paper substrate is lost, with the result that the press-moldability is lost. In contrast, in the laminate according to the present invention, since the permeation depth of the thermosetting resin is very small and the inherent elongation of the laminate is retained, a good press-moldability is maintained. Moreover, since permeation of the thermosetting resin into the paper substrate is controlled, a heat-insulating film is formed in a dense state on the surface of the paper substrate, and the heat resistance of the laminate is therefore improved.

Paper Substrate

As the paper substrate, there can be used natural and artificial papers formed from at least one member selected from natural pulps such as a conifer pulp and a hardwood pulp, inorganic fibers such as glass fiber, rock wool, slag wool, asbestos and ceramic fiber and pulps of synthetic resins such as polyolefins, polyester, polyamides and polyimides. A flame retardant filler may be incorporated into the paper stock. For example, there can be mentioned aluminum hydroxide, magnesium hydroxide, calcium aluminate and dawsonite. Aluminum hydroxide is especially effective for increasing the heat resistance. Moreover, in order to improve the touch or stiffness of the paper, silica, talc, clay, calcium carbonate or the like may be added. Furthermore, an organic resin binder can be used for improving the paper-forming property and binding or fixing fibers to one another. In the present invention, even if an ordinary paper formed from a wood pulp is used, a prominently high heat resistance can be advantageously imparted. It is preferred that the base weight of the paper substrate be 100 to 600 g/m$^2$, especially 150 to 400 g/m$^2$.

From the viewpoint of the heat resistance, a weakly acidic paper or neutral paper, especially a neutral paper formed by using an alkyl ketene dimer or alkenyl succinic anhydride as a sizing agent, is preferred.

Hiding Pigment

A non-toxic pigment or pigment having low toxicity having a large hiding power, especially a hiding power of 40 or less determined according to the method of JIS K-5101, is used as the hiding pigment in the present invention. For example, there are preferably used white pigments such as titanium white (R), yellow pigments such as titanium yellow, yellow iron oxide, chrome-titanium yellow, disazo pigments, condensed azo pigments, vat pigments, quinophthalone pigments and isoindoline, orange pigments such as monoazo lake pigments, disazo pigments, condensed azo pigments, pelynone and dibromoanthoanthrone, red pigments such as red iron oxide, monoazo lake pigments, disazo pigments, condensed azo pigments, perylene pigments, and quinacridone pigments, blue pigments such as cobalt blue, ultramarine, $\alpha$-cyanine blue and $\beta$-cyanine blue, green pigments such as chromium oxide green, titanium green and cyanine green, violet pigments such as dioxazine violet, and black pigments such as carbon black. These pigments may be used singly or in the form of a mixture of two or more of them. A pigment composed mainly of titanium white (titanium dioxide) of the rutile type or anatase type is preferred. Of course, a colored coating layer such as a coating layer of a cream color, a light pink color or a light blue color may be formed by incorporating a small amount of yellow iron oxide, red iron oxide or ultramarine into titanium white. Moreover, a filler or extender such as aluminum hydroxide, magnesium hydroxide, talc, clay, magnesium silicate or calcium silicate may be used in combination with the pigment.

Thermosetting Resin Paint

As the thermosetting resin, there is used at least one member selected from phenol-formaldehyde resins, furan-formaldehyde resins, xylene-formaldehyde resins, ketone-formaldehyde resins, urea-formaldehyde resins, melamine-formaldehyde resins, alkyd resins, unsaturated polyester resins, epoxy resins, bismaleimide resins, triallyl cyanurate resins, thermosetting resins and silicone resins. Resins having Tg of 90° to 130° C. are especially preferred.

In the present invention, a combination of an epoxy resin with a reactive acrylic resin and/or vinyl resin having a group reactive with the epoxy resin, for example, such a functional group as a carboxyl, hydroxyl or amino group, is preferably used as the thermosetting resin. Since this epoxy/acrylic or epoxy/vinyl paint is excellent in the processability in the crosslinked state and formation of a viscous substance on the surface of the mold is controlled, this paint is especially suitable for attaining the objects of the present invention.

An aromatic epoxy resin formed by condensing bisphenol A with an epihalohydrin is especially preferred as the epoxy resin component, and it is preferred that the epoxy equivalent of the aromatic epoxy resin be 1000 to 4000. As the acrylic resin, there can be mentioned copolymers of at least one monomer providing the above-mentioned functional group, which is selected from unsaturated carboxylic acids and anhydrides thereof such as methacrylic acid, acrylic acid and maleic anhydride, 2-hydroxyl (meth)acrylate group-containing monomers such as 2-hydroxyethyl (meth)acrylate and amino group-containing monomers such as 2-aminoethyl (meth)acrylate, 2-N,N-diethylaminoethyl (meth)acrylate and N-aminoethylaminoethyl (meth)acrylate, with at least one monomer selected from alkyl (meth)acrylates such as methyl methacrylate and ethyl acrylate, optionally with styrene. As the vinyl resin, there can be mentioned vinyl resins having a carboxyl group and/or a hydroxyl group, such as vinyl chloride/maleic anhydride copolymers, vinyl chloride/acrylic acid/acrylic acid ester copolymers, partially saponified vinyl chloride/vinyl acetate copolymers, vinyl chloride/maleic anhydride/styrene copolymers and saponified vinyl chloride/methacrylic acid/vinyl acetate copolymers.

It is preferred that the thermosetting resin be used in an aqueous dispersion comprising resin particles having a particle size of 0.05 to 1.0 $\mu$, especially an aqueous emulsion self-emulsified or emulsified with a surface active agent, an aqueous solution or a combination thereof.

An epoxy-acrylic resin, especially a self emulsifiable epoxy-acrylic resin, is preferred for attaining the objects of the present invention. A paint formed by reacting (A) an acrylic resin of the alkali neutralization type having a number average molecular weight of 10,000 to 100,000, which is formed by copolymerizing 12 to 30% by weight of acrylic acid or methacrylic acid with 70 to 88% by weight of at least one member selected from styrene, methylstyrene, vinyltoluene and alkyl esters of acrylic acid and methacrylic acid having 1 to 8 carbon atoms in the alkyl group with (B) an aromatic epoxy resin having 1.1 to 2.0 epoxy groups per molecule and a number average molecular weight of at least 1400 to obtain a carboxyl group-excessive epoxy resin/acrylic resin partial reaction product having a residual oxirane ring and dispersing the partial reaction product in an aqueous medium in the presence of ammonia or an amine in such an amount that the pH value of the final coating composition is 5 to 11 is especially preferred.

Moreover, a water-soluble paint formed by adding a small amount of butyl cellosolve or an alcoholic solvent to an acrylic-epoxy resin in which the acrylic resin-/epoxy resin ratio is increased, for example, to 8/2 or 9/1 can be used.

Still further, a water-soluble resin and a water-emulsifiable resin can be used in combination.

Preparation of Laminate

The laminate used in the present invention is obtained by preparing a coating liquid containing the above-mentioned thermosetting resin and hiding pigment, coating this coating liquid on both the surfaces of the paper substrate and curing the formed coating.

In the coating liquid, the amount of a medium such as water is reduced to a level as low as possible within the range providing a uniform coating. Namely, the solid concentration in the coating liquid is preferably adjusted to 20 to 80% by weight.

Known coating means such as spray coating, electrostatic coating, roller coating, gravure roll coating, dip coating and electrodeposition coating can be adopted.

If the amount coated on the paper substrate is adjusted to 2 to 50 g/m$^2$, especially 10 to 40 g/m$^2$, as the solid, satisfactory heat resistance and processability can be simultaneously obtained. Curing of the formed coating can be accomplished by known means. For example, a catalyst may be used, or curing may be accomplished by heating or irradiation with ultraviolet rays or radiations.

Molding of Laminate into Container

Molding of the laminate into a bottomed seamless container such as a tray, a bowl or a cup can be accomplished by heating male and female mold parts, supplying the laminate between them and carrying out press molding. If the mold is heated, the moldability of the laminate is prominently improved, as compared with the case where the mold is not heated. It is preferred that the mold be heated at 50° to 180° C., especially 90° to 150° C.

As is apparent from the foregoing description, according to the present invention, even if the container wall is heated above 300° C., the appearance characteristics, container strength and flavor-retaining properties can be prominently improved while retaining an excellent moldability in the paper laminate, and there can be provided a dual-ovenable container which can be treated in both of an electronic range and an oven toaster.

Moreover, if an appropriate combination of the thermosetting resin and hiding pigment is selected, even when press molding is carried out in a heated mold, formation and accumulation of a viscous substance on the surface of the mold can be prevented and a good moldability is ensured. Moreover, permeation of the coating layer into the paper substrate is controlled, and not only the moldability but also other properties can be improved.

The present invention will now be described in detail with reference to the following examples that by no means limit the scope of the present invention.

EXAMPLE 1

An aqueous epoxy-acrylic paint containing titanium white as the hiding paint was prepared according to the following procedures.

(A) Preparation of carboxyl group-containing acrylic resin

Styrene: 300.0 parts
Ethyl acrylate: 210.0 parts
Methacrylic acid: 90.0 parts
Ethylene glycol monobutyl ether: 388.0 parts
Benzoyl peroxide: 12.0 parts A four-neck flask having the inner atmosphere substituted with nitrogen was charged with $\frac{1}{4}$ of a mixture having the above composition and the content was heated at 80° to 90° C. While this temperature was being maintained, remaining $\frac{3}{4}$ of the mixture was gradually dropped over a period of 2 hours. After termination of the dropwise addition, the mixture was stirred at the above-mentioned temperature for 2 hours and the mixture was then cooled to obtain a solution of a carboxyl group-containing resin having an acid value of 93 (as calculated as the solid; the same will apply hereinafter), a solid content of 59.7% and a viscosity of 4100 cps (as determined at 25° C.; the same will apply hereinafter).

(B) Preparation of epoxy resin solution

Epikote 1007: 500 parts
Ethylene glycol monobutyl ether: 333.3 parts

A four-neck flask having the inner atmosphere substituted with nitrogen was charged with all of the above components, and the inner temperature was elevated to 100° C. and the content was stirred for 1 hour to dissolve the epoxy resin completely. Then, the temperature was lowered to 80° C. by cooling to obtain an epoxy resin solution having a solid content of 60%.

(C) Preparation of aqueous coating resin composition (1) Carboxyl group-containing acrylic resin solution (A): 100.0 parts
Epoxy resin solution (B): 50.0 parts
(2) 2-Dimethylaminoethanol: 9.3 parts
(3) Deionized water: 290.7 parts A four-neck flask was charged with all of the component (1) and then, the component (2) was added with stirring so that the contained carboxyl group was substantially equimolarly neutralized. The inner temperature was elevated to 80° C. and the mixture was stirred at this temperature for 30 minutes, and the mixture was cooled to room temperature. The oxirane reduction ratio was 63.5%, and the viscosity after cooking was 1.5 times the viscosity before cooking.

After cooking, the component (3) was gradually added while the mixture was being stirred, whereby a somewhat milky white dispersion having a solid content of 19.8% and a viscosity of 360 cps was obtained.

To the so-obtained dispersion were added titanium oxide of the rutile type having an oil absorption of 20 and a specific gravity of 4.2 in an amount equal to the amount of the solid in the dispersion and deionized water in such an amount that the total solid content of the resin and titanium oxide was 35%. The obtained mixture was kneaded by an attritor of the ball mill type to uniformly disperse the titanium oxide.

The so-obtained titanium white-containing aqueous epoxy-acrylic paint was cast on a glass sheet and dry-cured at 200° C. for 1 minute in an oven. The paint coating was peeled from the glass sheet. When the glass transition temperature (Tg) of the paint coating was measured by a scanning calorimeter (DSC), it was found that Tg was 115° C.

The titanium white-containing aqueous epoxy-acrylic paint was coated by a bar coater on both the surfaces of a paper substrate having an elongation of 2.0% in the longitudinal direction, an elongation of 6.0% in the lateral direction and a base weight of 300 g/m$^2$ and containing 5% by weight talc as the inorganic filler, which was formed of a 30/70 mixture of conifer pulp/-hardwood pulp as the chemical pulp, and the coating was dry-cured at 200° C. for 1 minute in an oven. The amount coated of the paint was 14 g/m$^2$ on each surface. The amount coated of the hiding pigment was 7 g/m$^2$ on each surface. Accordingly, the value $R_P$ was 1.0, which was included within the range of from 0.12 to 4.8 calculated by the formula of $R_P = k \cdot O_A \cdot d_R$ ($O_A = 20$, $d_R = 1.2$).

The elongation at break of the so-obtained laminate having both the surfaces coated with the titanium white-containing epoxy-acrylic paint was measured at a pulling speed of 4 mm/min by a tensile tester. The elongation at break was 5.8% in the longitudinal direction and 2.6% in the lateral direction.

Blanking and creasing were performed on this laminate having both the surfaces coated with the titanium white-containing epoxy-acrylic paint, and the laminate was press-molded in a pressing mold maintained at 140° C. to obtain a rectangular tray having a length of 16 cm, a width of 9.5 cm and a depth of 2 cm, as shown in FIG. 1.

At the molding step, the paint did not adhere to the mold or drop from the paper substrate, and molding could be satisfactorily performed without cracking or breaking.

Three skewers of grilled chicken were placed in this rectangular tray and stored in a refrigerator for 2 days, and the tray was heated for 4 minutes in an oven toaster. After heating, the skewered chicken was taken out from the tray and eaten. It was found that the chicken was maintained at an appropriate temperature and tasted good. The surface of the tray was not scorched and discoloration was not observed. When the surface temperature of the tray was measured during heating, it was found that the surface temperature was 300° C. or higher.

COMPARATIVE EXAMPLE 1

The procedures of Example 1 were repeated in the same manner except that a rectangular tray was formed from the paper not coated with the titanium white containing epoxyacrylic paint. By heating in the oven toaster, the surface of the tray was browned, and reduction of the strength was observed. If the rectangular tray was pressed by the hand, the wall was readily broken.

COMPARATIVE EXAMPLE 2

The procedures of Example 1 were repeated in the same manner except that a titanium white-containing thermoplastic polyester paint was used instead of the titanium white-containing epoxy-acrylic paint. At the press-molding step, the paint adhered to the mold, and molding was difficult. When the heating test in the oven toaster was carried out in the same manner as described in Example 1 by using the incomplete molded tray, the paint was softened by heat and there was a risk of sticking of the paint to the content. Accordingly, the tray was not suitable as a container.

EXAMPLES 2 AND 3 AND COMPARATIVE EXAMPLES 3 AND 4

By using the same epoxy-acrylic resin having a density of 1.2 and the same titanium oxide of the rutile type having an oil absorption of 20, as used in Example 1, an aqueous paint in which the epoxy-acrylic resin was present at a weight ratio ($R_P$) shown in Table 1 was prepared. By using this aqueous paint, a container was molded in the same manner as described in Example 1, and the container was subjected to the heating test. The obtained results are shown in Table 1. The containers prepared in Comparative Examples 3 and 4 in which the weight ratio ($R_P$) of the resin to the pigment was outside within the preferred range had no adaptability to the heat treatment in an oven toaster.

TABLE 1

| | $R_P$ | Content (% by weight) of Pigment in Solid | Moldability: Adhesion of paint to mold | Moldability: Dropping of cracking paint | Adaptability to Heating in Oven Toaster: discoloration | Adaptability to Heating in Oven Toaster: peeling of paint |
|---|---|---|---|---|---|---|
| Example 2 | 0.2 | 16.7 | none | none | none | none |
| Example 3 | 3.5 | 77.8 | none | none | none | none |
| Comparative Example 3 | 0.1 | 9.1 | slight | none | prominent | none |
| Comparative Example 4 | 5.0 | 83.3 | none | slight | none | prominent |

Note
preferred range of $R_P$: 0.12 to 4.8 ($O_A = 20$, $d_R = 1.2$)
$R_P = 1.2$ in case of $k = 0.05$
$R_P = 4.8$ in case of $k = 0.2$
amount coated of paint: 10 g/m$^2$ on each surface

EXAMPLE 4

In the aqueous coating resin dispersion prepared in (C) of Example 1 were incorporated titanium oxide of the rutile type having an oil absorption of 20 and a specific gravity of 4.2 in an amount equal to the amount of the resin solid and deionized water in such an amount that the total solid content of the resin and titanium oxide was 50%. The mixture was kneaded by an attritor of the ball mill type to uniformly disperse the titanium oxide.

The so-obtained titanium white-containing aqueous epoxy-acrylic paint was coated by a bar coater on both the surfaces of a neutral paper having an elongation of 2.0% in the longitudinal direction, an elongation of 6.0% in the lateral direction and a base weight of 300 g/m$^2$ and containing 5% by weight of talc as the inorganic filler and an alkyl ketene dimer as the sizing agent, which was formed of a 30/70 mixture of conifer pulp/-hardwood pulp as the chemical pulp, and the coating was dry-cured at 200° C. for 1 minute. The amount coated of the paint was 14 g/m² on each surface, and the amount coated of the hiding pigment was 7 g/m² on each surface.

Figure 3:
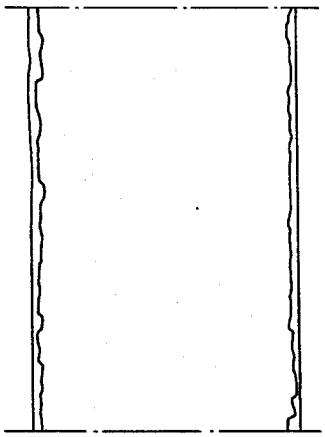
FIG. 3 is a microscopic diagram illustrating the sectional structure of a laminate prepared in Example 1.
Figure 4:
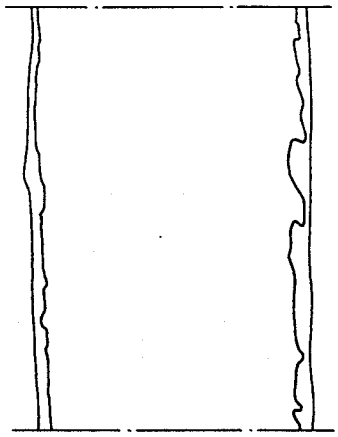
FIGS. 4, 5, 6 and 7 are microscopic diagrams illustrating the sectional structures of laminates prepared in Examples 5 through 8, respectively.
Figure 5:
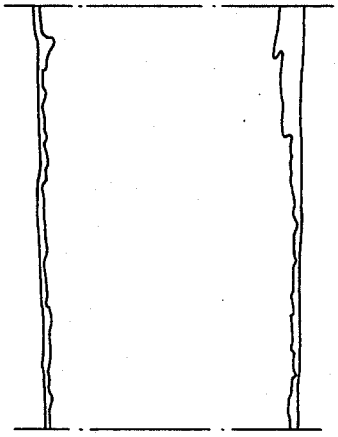
Figure 6:
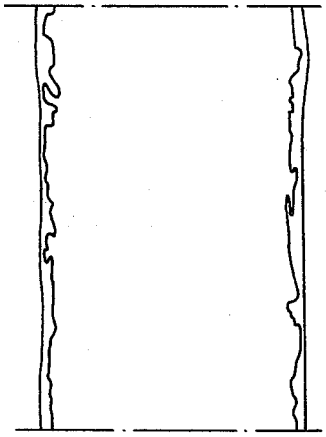
Figure 7:
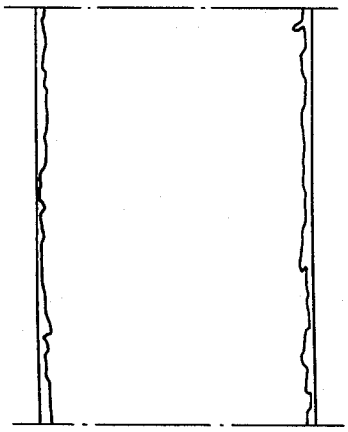
Figure 8:
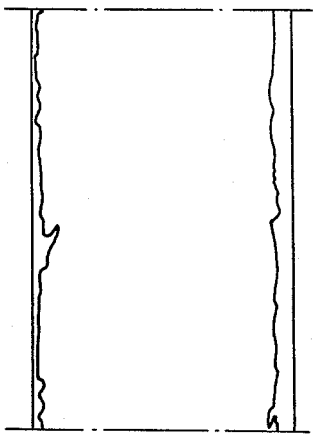
FIGS. 8 and 9 are microscopic diagrams illustrating the sectional structures of laminates obtained in Comparative Examples 5 and 6, respectively.
Figure 9:
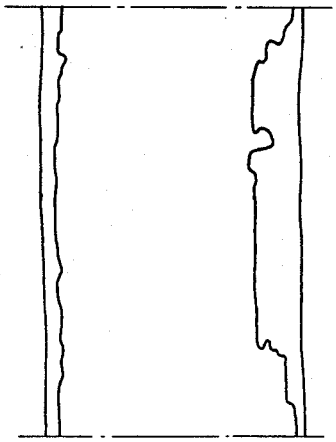

An enlarged photo of the section of the so-obtained laminate, obtained by using an optical microscope, is shown in FIG. 3. From FIG. 3, L and l were determined. L was 380 μm, and the maximum value of l was 21.7 μm, the minimum value of l was 6.9 μm and the average value of l was 10.3 μm. Accordingly, the maximum value of l/L was 0.057, the minimum value of l/L was 0.018 and the average value of l/L was 0.027.

Blanking and creasing were performed on the laminate having both the surfaces coated with the titanium white-containing epoxy-acrylic paint, and the temperature of the laminate was adjusted and the laminate was press-molded in a pressing mold to obtain a rectangular tray having a length of 16 cm, a width of 9.5 cm and a depth of 2 cm, as shown in FIG. 1.

At the molding step, adhesion of the paint to the mold or dropping of the coating was not caused, and molding was satisfactorily performed without cracking or breaking.

Six chicken nuggets were charged in this rectangular tray and stored for 2 days in a refrigerator, and the tray was heated for 8 minutes in an oven toaster. After heating, the chicken nuggets were eaten. It was found that the chicken nuggets were maintained at an appropriate temperature and tasted good. The surface of the tray was not scorched and discoloration was not observed.

EXAMPLE 5 THROUGH 8 AND COMPARATIVE EXAMPLES 5 AND 6

A paint shown in Table 2 was coated on both the surfaces of the same paper substrate as used in Example 4 by a bar coater so that the amount coated of the paint was 14 g/m² as the solid on each surface, and the coating was dried and cured at 200° C. for 1 minute in an oven.

Enlarged photographs of the sections of the obtained laminates, obtained by an optical microscope, are shown in FIGS. 4 through 9. From these Figs., L and l were calculated and the values of l/L were calculated. The obtained results are shown in Table 2.

Blanking and creasing were performed on each laminate, and rectangular trays having a length of 16 cm, a width of 9.5 cm and a depth of 2.0 cm, as shown in FIG. 1, were molded by using a pressing mold maintained at 140° C. At the molding step, adhesion of the paint to the mold, falling of the paint, cracking of the coating layer and breaking of the laminate were checked to evaluate the moldability. The results are shown in Table 2. As is apparent from Table 2, if an organic solvent type paint was used, the value of l/L was increased, and breaking or cracking was often caused at the molding step.

TABLE 2

| | Paint | | | Hiding Paint | | Resin permeation depth | | Press Moldability | | |
|---|---|---|---|---|---|---|---|---|---|---|
| | type | resin | resin ratio | kind | content (% by weight) of pigment in solids | l/L (average value) | FIG. No. | adhesion of paint to mold | cracking of paint | breaking of laminated |
| Example 5 | aqueous dispersion | epoxy-acrylic | epoxy/acrylic = 2/1 | titanium white | 50 | 0.043 | 4 | none | none | none |
| Example 6 | aqueous solution | epoxy-acrylic | epoxy/acrylic/amino = 2/1/0.3 | titanium white | 60 | 0.034 | 5 | none | none | none |
| Example 7 | aqueous solution | epoxy-acrylic | epoxy/acrylic/amino = 8/2/1 | titanium white | 60 | 0.041 | 6 | none | none | none |
| Example 8 | aqueous dispersion/solution mixed type | epoxy-acrylic | epoxy/acrylic = 1/1 | titanium white | 60 | 0.035 | 7 | none | none | none |
| Comparative Example 5 | organic solvent type | epoxy-acrylic | epoxy/acrylic = 2/1 | titanium white | 60 | 0.120 | 8 | none | prominent | prominent |
| Comparative Example 6 | organic solvent type | epoxy-phenolic | epoxy/phenolic = 2/1 | titanium white | 60 | 0.132 | 9 | none | prominent | prominent |

EXAMPLES 9 THROUGH 12 AND COMPARATIVE EXAMPLES 7 THROUGH 12

A paint shown in Table 3 was coated on both the surfaces of the same paper substrate as used in Example 4 by a bar coater so that the amount coated of the paint was 30 g/m² as the solid on each surface, and the coating was dried and cured at 190° C. for 4 minutes in an oven.

After curing, Tg by DSC and the elongation at break of the laminate were determined. The obtained results are shown in Table 3.

Blanking and creasing were performed on each laminate, and a rectangular tray having a length of 16 cm, a width of 9.5 cm and a depth of 2.0 cm, as shown in FIG. 1, was molded in a pressing mold maintained at 140° C. Adhesion of the paint to the mold, falling of the paint, cracking of the paint and breaking of the laminate were checked to evaluate the moldability. The obtained results are shown in Table 3. As is apparent from Table 3, when a laminate having a low elongation at break was used, breaking of the laminate or cracking of the coating layer was often caused. Furthermore, if a paint having low Tg was used, adhesion of the paint to the mold was caused at the molding step.

TABLE 3

| | Paint | | Elongation (%) at Break of Laminate | | Hiding Pigment | | Press Moldability | | | |
|---|---|---|---|---|---|---|---|---|---|---|
| | Kind | Tg (°C.) | MD | CD | kind | content (% by weight) of pigment in solids | adhesion of paint to mold | falling of paint | cracking of paint | breaking of laminate |
| Example 9 | water-soluble epoxy-acrylic | 98 | 5.9 | 2.5 | titanium white | 60 | none | none | none | none |
| Example 10 | aqueous dispersion type epoxy-acrylic | 105 | 6.4 | 2.7 | titanium white | 50 | none | none | none | none |
| Example 11 | aqueous dispersion type epoxy-acrylic | 104 | 5.6 | 2.4 | titanium white | 50 | none | none | none | none |
| Example 12 | solvent type epoxy-vinyl | 108 | 6.0 | 2.5 | titanium white | 50 | none | none | none | none |
| Comparative Example 7 | solvent type epoxy-acrylic | 114 | 4.3 | 1.4 | titanium white | 50 | none | slight | prominent | prominent |
| Comparative Example 8 | water-soluble epoxy-acrylic | 87 | 6.0 | 2.6 | titanium white | 50 | prominent | none | none | none |
| Comparative Example 9 | thermoplastic vinyl chloride | 70 | 6.5 | 2.5 | titanium white | 50 | prominent | none | none | prominent |
| Comparative Example 10 | thermoplastic polyester | 60 | 6.8 | 2.6 | titanium white | 50 | prominent | none | none | prominent |
| Comparative Example 11 | solvent type epoxy-phenolic | 105 | 4.4 | 2.1 | titanium white | 50 | none | slight | prominent | slight |
| Comparative Example 12 | solvent type epoxy-phenolic | 132 | 4.2 | 2.0 | titanium white | 50 | none | slight | prominent | prominent |

We claim:

1. A heat-resistant paper container which comprises a bottomed seamless press-molded body comprising a laminate of a paper substrate having an elongtion of at least 1.5% in the longitudinal direction and an elongation of at least 4.5% in the lateral direction and a coating layer of a hiding pigment comprising titanium dioxide formed on both the surfaces of the paper substrate, wherein the amount coated of the hiding pigment is 1 to 50 g/m$^2$, the binder in the coating layer is an eqoxy-acrylic or epoxy-vinyl thermosetting resin and the binder is present in the coating layer at a weight ratio $R_P$ satisfying the following condition $$R_P = k \cdot O_A \cdot d_R \quad (1)$$

wherein $O_A$ stands for the oil absorption (ml/100 g) of the hiding pigment, $d_R$ stands for the density (g/ml) of the binder, and k is a number of from 0.005 to 0.2.

2. A heat-resistant paper container as set forth in claim 1, wherein the thermosetting resin has a glass transition point of 90° to 130° C. as measured by a scanning calorimeter.

3. A heat-resistant paper container as set forth in claim 1, wherein the coating layer is formed so that the condition of $l/L < 0.1$ is satisfied, in which L stands for the thickness of the laminate and coating layer and l stands for the permeation depth of the resin from the surface of the coating layer into the paper substrate.

4. A heat-resistant paper container as set forth in claim 1, wherein the paper substrate is a paper having a low acidity or a neutral paper.

5. A heat-resistant paper container as set forth in claim 3, wherein the coating layer is formed so that the condition of $0.015 \leqq l/L < 0.08$ is satisfied.

6. A heat-resistant paper container as set forth in claim 4, wherein the paper substrate has been treated with a neutral or weakly acidic sizing agent.

7. A heat-resistant paper container as set forth in claim 6, wherein the paper substrate is a neutral paper formed by using an alkyl ketene dimer or alkenyl succinic anhydride as a sizing agent.

8. A heat-resistant paper container as set forth in claim 1, wherein the pigment is composed of a rutile type or anatase-type titanium dioxide.

9. A heat-resistant paper container as set forth in claim 1, wherein the epoxy resin component of the epoxy-acrylic or epoxy-vinyl thermosetting resin is an aromtic epoxy resin formed by condensing bisphenol A with an epihalohydrin having an epoxy equivalent of 1,000 to 4,000.

10. A heat-resistant paper container as set forth in claim 1, wherein the thermosetting resin is present as an aqueous dispersion comprising resin particles having particle size of 0.05 to 1.0 μ.

11. A heat-resistant paper container as set forth in claim 1, wherein the thermoplastic resin is a self-emulsifiable epoxy-acrylic resin.

* * * * *